United States Patent [19]

Gavin

[11] 3,967,341

[45] July 6, 1976

[54] VACUUM AND COMBINATION VACUUM/BLOW MEANS

[76] Inventor: Linus A. Gavin, Box 136, Bagg Road, Chesterfield, Mass. 01012

[22] Filed: Aug. 14, 1975

[21] Appl. No.: 604,638

[52] U.S. Cl. ..... 15/345; 15/409

[51] Int. Cl.[2] ..... A47L 5/14; A47L 5/16

[58] Field of Search ..... 15/345, 409

[56] References Cited

UNITED STATES PATENTS

| | | | |
|---|---|---|---|
| 1,984,359 | 12/1934 | Bridgham | 15/409 X |
| 2,074,666 | 3/1937 | Patalano | 15/409 |
| 2,688,835 | 9/1954 | Rawson | 15/409 X |
| 2,851, 213 | 9/1958 | Swallert | 15/409 X |
| 3,683,446 | 8/1972 | Tell | 15/409 X |
| 3,922,753 | 12/1975 | Aberilla | 15/409 |

FOREIGN PATENTS OR APPLICATIONS

| | | | |
|---|---|---|---|
| 366,797 | 10/1906 | France | 15/345 |
| 659,365 | 5/1938 | Germany | 15/409 |
| 221,974 | 8/1968 | Sweden | 15/409 |

*Primary Examiner*—Christopher K. Moore
*Attorney, Agent, or Firm*—Ross, Ross & Flavin

[57] ABSTRACT

Modifications of air or blow guns are disclosed, first, wherein the air or blow gun is converted to a suction gun in the respect that a vacuum or suction is generated at the normal discharge end of the gun, and second, wherein the discharge end of the gun is selectively converted from an air or blow gun to a vacuum or suction gun and vice versa.

3 Claims, 9 Drawing Figures

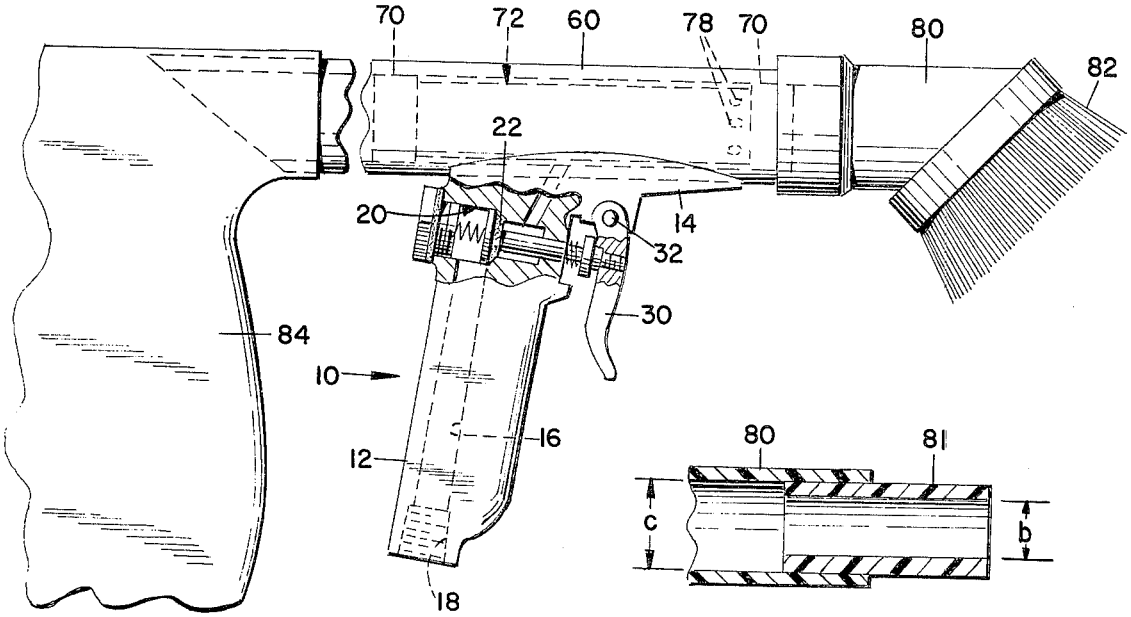
FIG. 1.
FIG. 3.
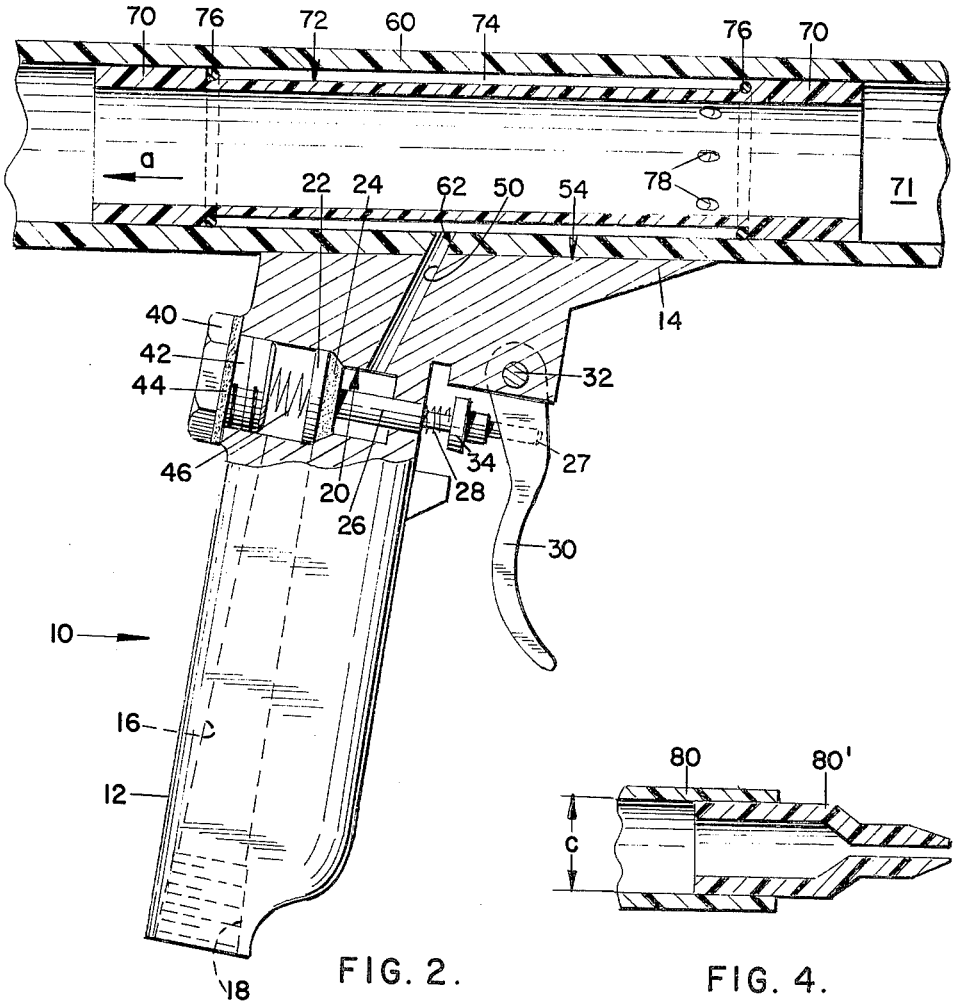
FIG. 2.
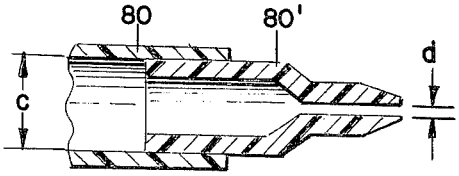
FIG. 4.

VACUUM AND COMBINATION VACUUM/BLOW MEANS

This invention is directed to modified versions of an air or blow gun, a first version of which serves as a vacuum cleaner in the respect that it sucks up lint or dust or chips or the like from workpieces (such as metal parts or castings), machines and work clothes in such as metal shops and textile, rubber, cement and like plants, and a second version of which serves as a combination air or blow gun and a vacuum cleaner with the selectivity being allowed in that the apparatus can be readily converted from one form to the other at the operator's will.

In one way, the invention may be defined as a pickup device which may be used as a vacuum cleaner or as a pressure device to pick up objectional particles from an object or a surface and transport them to a distant collecting point.

This invention envisions an air gun coupled with a supplemental gas-directing means whereby the jet stream flow is reverted with respect to its passage along its normal longitudinal flow axis so as to induce such a rearward or retrograde rush of air as to create a suction or vacuum at the so-called nozzle, normally the discharge point of the pressurized air. In lieu of a forwardly-directed air flow, a rearwardly-directed intake is defined so as to give a vacuum pickup effect at the nozzle.

In the first exemplifications hereof (FIGS. 1–4), vacuum cleaner types of construction are disclosed.

In a second exemplification or modified form of the invention (FIGS. 5–9), an apparatus is shown and described which may be selectively converted between an air blower and a suction cleaner by the mere flip of a valve-rotating switch. It has for its particular object the provision of a hand blower for cleaning machinery and the like which may be quickly and easily converted into a suction device. In other words, it comprehends a cleaner having a suction opening and an auxiliary air discharge opening.

A hand air blower is an efficient known type of cleaner for blowing dust from machinery and for any other cleaning task wherein it is not desired to entrap and dispose of the dust or other material removed by the blower. It suffers the known disadvantage that it tends to scatter the offending material into myriad directions with the known factor remaining that in due time such scattered material will in all likelihood have to be removed again.

The preferred means for waste material removal is acknowledged to involve the use of a suction device.

While theoretically it is possible to convert the ordinary type of blower into a suction device, in normal practice this would dictate a substantial rebuilding effort. The present invention provides a blower which can most easily and economically be converted from a blower to a suction cleaner.

In a conventional vacuum cleaner, it requires a certain built-in horsepower to produce a desired pressure reduction or vacuum at the pickup nozzle. In contrast, with the booster arrangement of this invention, the flow of pressurized air is through the conventional air gun and into and from a flow reversal or transfer means wherewith its customary path of forward travel is abruptly reversed into a path of rearward travel by the forcement of same through a series of circumferentially-arranged rearwardly-inclined or facing, helically-directed restricted openings or bleeds, all so as to generate an effective suction or vacuum at the forward or delivery nozzle end of the apparatus.

As known, pressurized air is commonly used as a power source in industry, being conventionally supplied via a compressor to various air-powered instruments, such as riveting guns, presses, jackhammers and like pneumatic tools, and being used additionally in stream form for purposes of removing dust, chips and like waste from workpieces, work benches, work clothes and the like. Also as known, when the workman wishes to clean his machine or his clothes or whatever, he manually opens the valve and aims the gun to direct a high-velocity, low-volume stream of air toward the object to be cleaned. Lightweight particles of dust, metal chips, lint and the like as struck by the air stream, are accelerated thereby only to fly off into the air in various directions. Cleansing by such means is a notoriously dangerous practice, and there have been many injuries attributable to flying particles lodged in workmen's eyes and other parts of their bodies. Other ridiculous injuries frequently result when the orifice of such a gun is, as a practical joke, pushed against a workman's body or into a body opening whereby the high pressure stream of air might quickly pass through the epidermis and into the blood stream, conceivably causing serious injury, and sometimes even death.

With this invention, the guns hereof will direct a stream of air in a sucking action therethrough and outwardly thereof, preferably into a collecting bag or canister, as may be desired. When used as an air gun, the nozzle end is so choked that the need for reducing the static nozzle pressure to reasonable and safe limits, say in the order of something less than 30 psi, is no longer necessary. In such modified construction, wherein the air blast may be selectively employed, same is delivered adjacent the enlarged suction nozzle of the first exemplification in a manner such that it cannot be used improperly or wrongfully as a dangerous blast type of gun.

In the drawings:

FIG. 1 is a broken view in side elevation with certain parts in section to show one form of the apparatus of the invention;

FIG. 2 is an enlarged view in section of the central portion of the FIG. 1 apparatus;

FIGS. 3 and 4 are detailed views in section of modified forms of the suction nozzle of the FIG. 1 apparatus;

Figure 5:
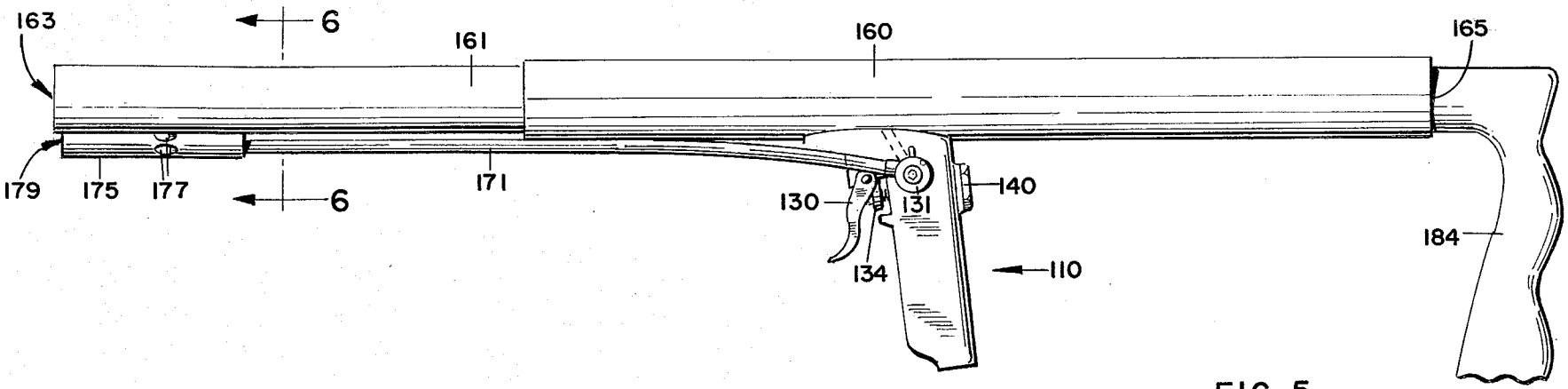
FIG. 5 is a fragmentary small scale view in side elevation of another modified form of the invention.
Figure 8:
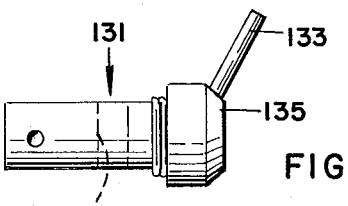
FIGS. 8 and 9 are large scale views of the control valve employed in the FIG. 5 modification.
Figure 9:
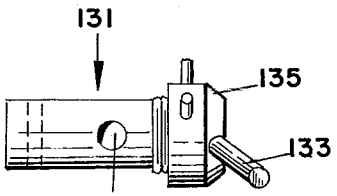

A gun body, generally represented by 10, has a grip or inlet end 12 and a nozzle or outlet end 14 angularly related thereto.

Grip end 12 is formed with a passage 16 leading thereinto from a threaded inlet 18 to allow connection with a flexible line extending from conventional compressed air equipment (not shown).

Passage 16 communicates at its inboard end with the enlarged outboard section of a circular well or cavity 20 having an annular tapered shoulder serving as a dividing zone separating the enlarged outboard section from the smaller diametered inboard section and serving as a seat for a valve 22 having a resilient seat 24 and an inboard stem 26 extending inwardly from the valve and through the seat.

Valve 22 is reciprocable relative to the gun body so that, in closed (FIGS. 1 and 2) position, the valve sits on the seat of the well to close off communication between the well outboard and inboard sections and, in opened position, the valve is distantly of the seat to allow communication between said sections.

A trigger 30 of conventional configuration is pivotally mounted on the gun body by a trigger pivot pin 32 and an extension 27 of stem 26 extendable through a suitable opening in the gun body normally seats thereupon distantly of the trigger pin so that the valve is reciprocated by trigger actuation. A trigger spring 28 circumscribes stem extension 27 and a knurled manually-engageable adjusting nut 34 is threadedly engaged on stem extension 27 for the obvious function of adjusting and controlling the reciprocating stroke of the valve.

The enlarged outboard section of valve well 20 is internally threaded and a nut 40 having a depending threaded portion 42 is threadedly engaged therewith in serving the valve well closing function. A gasket 44 circumscribing threaded portion 42 ensures a tight closure.

A valve spring 46 nestably seats in opposed spring seats in threaded portion 42 and valve 22 and urges the valve returnably onto its seat upon trigger release.

Outlet end 14 is provided with an angularly-inclined through passage 50 communicating with the inboard section of the well.

The outermost wall 54 of outlet end 14 defines a concave configuration for the accommodation of the midsection of a tubular longitudinally-extending barrel or transfer means 60 which is rigidly secured thereto as by a suitable cementious material or bolting or both.

An angularly-inclined opening 62 through the wall of the barrel or transfer means is coaxially aligned with through passage 50.

Within barrel or transfer means 60, a tubular flow interrupter 70 is slideably received so as to form a snug fit with the inner wall 64 thereof.

Inboard of the opposite ends of flow interrupter 70 an outer peripheral recess 72 is provided so as to define an annular space 74 between the transfer means and flow interrupter which may be sealed off at each of its opposite extremities by an O-ring 76.

By virtue of the angular inclination of aligned passage 50 and opening 62, the pressurized air is charged angularly into annular space 74 to impart a direction of movement therewithin in an inboard direction, aided and abetted by the fact that provided in flow interrupter 70 in the area adjacent O-ring 76 at the inboard end of annular space 74, are a plurality of spaced circumferentially-arranged rearwardly-inclined helically-directed restricted flow-reversal passages 78.

Pressurized air entering annular space 74 is passed therethrough in a forwardly-facing direction only to be blocked from continued forward passage by the sealed end wall defined by the annular space of the flow interrupter and finding its escape route via the several flow-reversal passages 78. With the flow so reversed, the air then is charged in a rearwardly-directed swirling motion into the interior of the flow interrupter whence it follows the path of least resistance, passing rearwardly in the direction indicated by arrow a, thereby generating a vacuum within the interior area 71 of the transfer means 60 forwardly of flow interrupter 70.

The forward or inboard extremity of transfer means 60 may be provided with a head 80 having a brushlike attachment 82 or similar working appliance fitted to the outermost nozzle end thereof and communicating with the transfer means and with a collecting appliance 84 such as a collecting bag fitted to opposite outermost end thereof.

It is to be appreciated that transfer means 60 may be made of any length so as to accommodate to situations where a tool of relatively short length may be desired (as where it is desired to reach closely into the work area) as well as to situations where a tool of relatively long length may be desired (as where it may be desired to avoid the need for reaching and bending over).

In lieu of the disclosed head 80 incorporating a brushlike means, the nozzle or vacuum end of barrel 60 may be provided, as shown in FIG. 3, with a tubular restricted-opening head 80' comprised of a relatively short tubular barrel having an outside diameter of suitable dimension so as to adapt the restricted opening head to be strategically and nestably received within the inside diameter of barrel 80 a distance such as to be secure relative thereto during operational use. The restricted opening head will allow a nozzle of a smaller diameter denoted as *b*, being something less than the diameter of the barrel 80 denoted as *c*, to enhance the suction effect by the enforced drawing in of air through a relatively smaller passageway.

And in lieu of the FIG. 3 modification, another type of restricted opening head may be provided, as shown in FIG. 4, incorporating a tubular restricted-opening head 80'' comprised of a relatively short tubular barrel having an outside diameter of a dimension such as to be sleeved within the inside of barrel 80 but having an outer compressed noselike configuration such as to define an outermost through passage having a diameter *d* which is less than the diameter *b* shown in FIG. 3, all so as further to enhance the suction effect for certain types of contemplated operational use.

Now with reference to FIGS. 5–9, a modified form of vacuum cleaner will be described.

Figure 7:
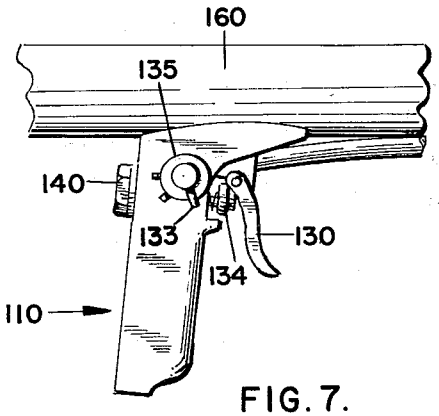
FIG. 7 is a partial view in side elevation showing the opposite side of the FIG. 5 modification.
Figure 6:
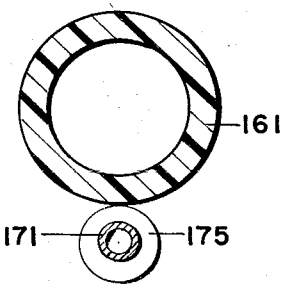
FIG. 6 is an enlarged sectional view on line 6—6 of FIG. 5.

A similar type of gun body designated as 110 is employed so as not to dictate a repetitive description of the components thereof, a trigger 130, adjusting nut 134, and nut 140, being observable in FIGS. 5 and 7 showing opposite sides of the apparatus.

Barrel 160 may be of a single length such as to extend between the nozzle end denoted by 163 and the release end denoted by 165, or, if desired, it may incorporate in addition thereto a secondary tubular barrel 161 of reduced diameter which may be sleeved therewithin as in the FIG. 3 showing.

The gun body 110 otherwise differs from gun body 10 in that a cylindrical secondary valve 131 is extendable through the gun body in a provided opening disposed transfersely to and intersecting the inboard section of the circular well, the secondary valve being rotatable relative to the gun body by means of an operating handle 133 extending angularly outwardly from the enlarged head 135 of the valve between a first position wherein a through opening 137 is blocked from communicating with the valve well and a second position where through opening 137 is in communication with the valve well. In the said first position, the pressurized air is passed through the well and into the annular space formed by the flow interrupter and thence therethrough to the canister or bag or collecting appliance 180 as in the FIGS. 1–2 form.

Alternatively, and selectively as desired, the valve may be rotated to the second position whereby the air passes from the valve well through through opening 137 and into and through a tube 171 coupled at its outboard end to a collar 173 circumscribing the valve adjacent the valve head 135. The aligned through passage 50 and opening 62 now being blocked, the passage of this pressurized air is forwardly from the valve well through the through opening 137 and outwardly through tube 171 and into an enlarged choke 175 circumscribing the tube at its forward extremity.

As shown, tube 171 is disposed vertically below and relative to the forward end of transfer means 160 and 161, choke 175 being fixed thereto as by a weldment or the like.

The choke is provided with a plurality of inclined rearwardly-directed openings 177 for use in the event of any dead ending or obstructing of nozzle end 179, any back pressure buildup being precluded by the escape of air from the choke interior through openings 177 to atmosphere.

It will be obvious that I have provided a convertible air cleaner which may in a moment be converted from a blower to a suction cleaner and vice-versa. While I have illustrated a practical device, many changes might be made in size, number, shape and disposition of parts without departing from the spirit of my invention and I wish the specification and drawings to be taken, therefore, as in a broad sense diagrammatic, and not as limiting me to the specific details and arrangements therein shown.

I claim:

1. In an air gun converted to a suction cleaner and having an air inlet connected to a source of pressurized air and an air outlet and a trigger-actuated valve means therebetween, the improvement comprising: a tubular longitudinally-extending barrel mounted on the air gun and having an angular opening in the wall thereof coaxially aligned with the air outlet, a tubular flow interrupter sealingly-sleeved within the barrel and having an outer peripheral recess inboard of its opposite ends defining a sealed annular air space between the barrel and flow interrupter in communication with the barrel opening, a plurality of spaced circumferentially-arranged angularly inclined rearwardly directed flow reversal openings in the wall of the flow interrupter communicating between the air space and interior of the flow interrupter for bleeding pressurized air from the former to the latter while reversing the direction of flow thereof toward the rearward barrel extremity while generating a suction at the forward barrel extremity, a brush means fitted to the forward barrel extremity, and a collecting means fitted to the rearward barrel extremity.

2. In a suction cleaner including an air gun having an air inlet connectd to a source of pressurized air and an air outlet and a trigger-actuated valve means therebetween, the improvement comprising: a tubular longitudinally-extending barrel fixed to the air gun and having an opening in the wall thereof coaxially aligned with the air outlet, a tubular flow interrupter sealingly-sleeved within the barrel and having an outer peripheral recess inboard of its opposite ends defining a sealed annular air space between the barrel and flow interrupter in communication with the barrel opening, a plurality of spaced circumferentially-arranged angularly inclined rearwardly directed flow reversal openings in the wall of the flow interrupter communicating between the annular air space and the interior of the flow interrupter for bleeding pressurized air from the former to the latter while reversing the direction of flow thereof toward the rearward barrel extremity and while generating a suction at the forward barrel extremity and a collecting means fitted to the rearward barrel extremity.

3. In an air gun converted to a suction cleaner and having an air inlet connected to a source of pressurized air and an air outlet and a trigger actuated valve means therebetween, the improvement comprising: a tubular longitudinally extending barrel mounted on the air gun and having opposite forward and rearward extremities and an opening in the wall thereof coaxially aligned with the air outlet, a tubular flow interrupter sealingly sleeved within the barrel and having an outer peripheral recess inboard of its opposite ends defining a sealed annular air space in communication with the barrel opening, a plurality of spaced circumferentially-arranged angularly inclined rearwardly directed flow reversal openings extending through the wall of the flow interrupter and communicating between the air space and interior of the flow interrupter for bleeding pressurized air from the former to the latter while reversing the direction of flow thereof through the barrel and toward the rearward barrel extremity while generating a suction at the forward barrel extremity, a rotatable selector valve means receivable within the air gun and in communication with the trigger actuated valve means and being actuatable for closing off the air outlet, a tube having a forward nozzle end and being connectible at its opposite end of the selector valve means and extendable to a point of adjacency to the forward barrel extremity and serving as a passage for the pressurized air from the trigger actuating valve means to the forward nozzle end.

* * * * *